United States Patent [19]

Lokvig

[11] Patent Number: 4,476,650

[45] Date of Patent: Oct. 16, 1984

[54] TRIGGER ACTUATED PUPPET

[75] Inventor: Tor Lokvig, Encino, Calif.

[73] Assignee: Intervisual Communications Inc., Los Angeles, Calif.

[21] Appl. No.: 417,675

[22] Filed: Sep. 13, 1982

[51] Int. Cl.[3] ..... A63H 7/00

[52] U.S. Cl. ..... 446/362

[58] Field of Search ..... 46/126, 148, 154, 142, 46/77, 119, 123, 128, 139

[56] References Cited

U.S. PATENT DOCUMENTS

| | | | |
|---|---|---|---|
| 1,489,385 | 4/1924 | Ciavatti | 46/126 X |
| 1,736,163 | 11/1929 | McGee | 46/142 |
| 2,327,234 | 8/1943 | Wolff et al. | 46/126 |
| 2,551,195 | 5/1951 | Wirth | 46/126 X |
| 2,595,971 | 5/1952 | Mossbauer | 46/126 X |
| 3,178,852 | 4/1965 | Whitcomb | 46/126 |
| 3,874,112 | 4/1975 | Sapkus et al. | 46/148 X |
| 3,916,562 | 11/1975 | Burkhart | 46/126 X |

FOREIGN PATENT DOCUMENTS

| | | | |
|---|---|---|---|
| 694083 | 7/1940 | Fed. Rep. of Germany | 46/126 |

*Primary Examiner*—Robert A. Hafer
*Assistant Examiner*—D. D. DeMille
*Attorney, Agent, or Firm*—Gerald L. Price

[57] ABSTRACT

A puppet or doll having a plurality of articulated limbs and a pistol grip attached to the puppet body for selectively activating the limbs. The limbs are pivotally connected to the puppet body and the grip includes openings therein for insertion of one's fingers and trigger assemblies actuable from the openings connected to the limbs by strings for activating the same.

6 Claims, 6 Drawing Figures

Fig. 3
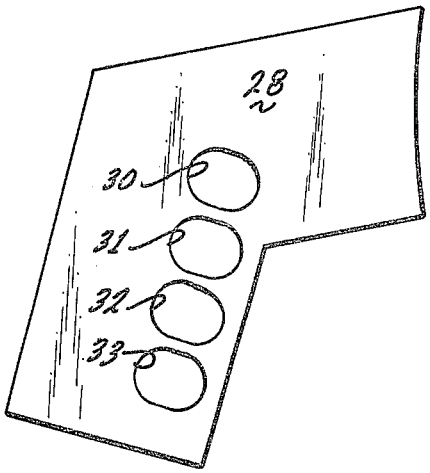
Fig. 4
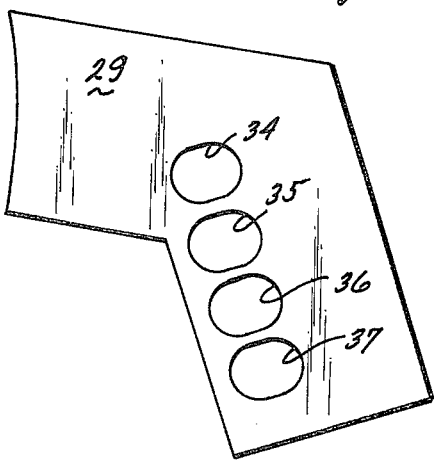
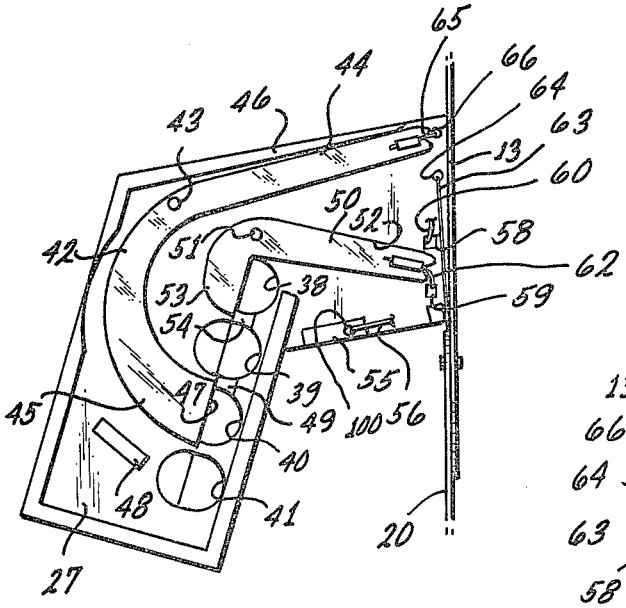
Fig. 5
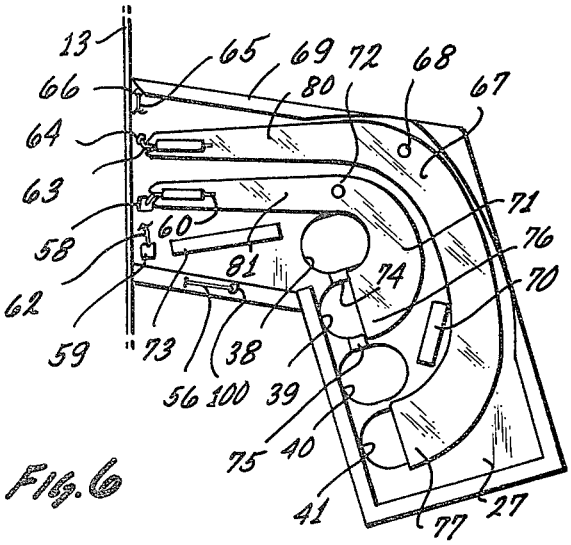
Fig. 6

TRIGGER ACTUATED PUPPET

BACKGROUND OF THE INVENTION

1. Field of the Invention

The invention relates to articulated puppets; and, more particularly, to an articulated puppet or doll having a pistol grip connected thereto with finger manipulable trigger assemblies in the grip connected to limbs on the doll or puppet for selectively activating the same.

2. Description of the Prior Art

Various puppet and doll constructions and marionettes are well known in the art wherein limbs of the puppet body are selectively activated through control means.

In U.S. Pat. No. 2,570,737 to Whitcomb, a conventional marionette is disclosed having a plurality of strings connected to individual limbs of the marionette. The strings are coupled to a plurality of ring elements on a control panel and selective engagement of the rings activates selective limbs. Such an arrangement is quite prone to entanglement and the marionette can only be used in the structure containing the control panel.

In U.S. Pat. No. 2,633,670 to Steuber, a hand puppet is disclosed having a body wherein the operator's hand may be inserted to engage certain levers to move the parts of the puppet body. Such an arrangement is quite complicated and expensive and may be difficult for a small child to operate.

In U.S. Pat. No. 3,893,257 to Miki, a puppet head is disclosed having pivotally movable eyeballs and a lip which are connected by wires to loops (FIG. 4*b*) whereby selective pulling on the wires activates the eye-balls and lip. Again, such an arrangement is complicated, expensive and difficult for a child to operate.

There is thus a need for a doll or puppet which is inexpensive to manufacture, made from relatively uncomplicated parts, portable and easy for a child to operate without danger of entanglement of strings or wires or the like.

SUMMARY OF THE INVENTION

It is an object of this invention to provide a portable puppet having articulated limbs, and a pistol grip coupled to the puppet body for selective activation of limbs thereof.

It is another object of this invention to provide such a puppet wherein the limbs are pivotally connected to the puppet body and activated by strings connected at one end to the limbs and at the other end to the pistol grip.

It is still another object of this invention to carry out the foregoing objects in a manner whereby the strings are connected to trigger assemblies in the pistol grip, which assemblies can be selectively activated to move selective limbs of the puppet without danger of entanglement of the strings.

It is another object of this invention to carry out the foregoing objects having a puppet body and grip which can be made from stiff planar material sold as an inexpensive flat package.

These and other objects are preferably accomplished by providing a puppet or doll having a plurality of articulated limbs and a pistol grip attached to the puppet body for selectively activating the limbs. The limbs are pivotally connected to the puppet body and the grip includes openings therein for insertion of one's fingers and trigger assemblies actuable from the openings connected to the limbs by strings for activating the same.

BRIEF DESCRIPTION OF THE DRAWING

FIG. 3 is a view taken along lines III—III of FIG. 2;

FIG. 4 is a view taken along lines IV—IV of FIG. 2;

FIG. 5 is a view taken along lines V—V of FIG. 2; and

FIG. 6 is a view taken along lines VI—VI of FIG. 2.

DESCRIPTION OF THE PREFERRED EMBODIMENT

Figure 1:
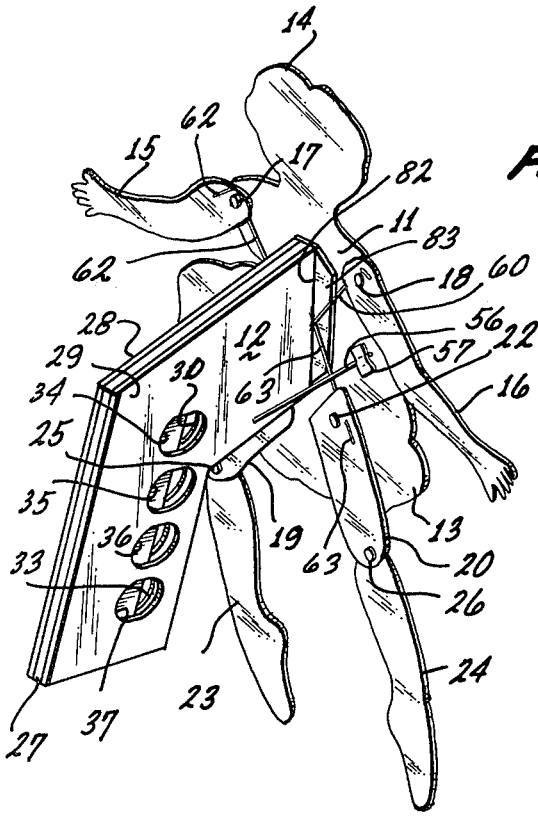
FIG. 1 is a rear perspective view of the puppet of the invention.

Referring now to FIG. 1 of the drawing, a trigger actuated puppet 10 is shown comprised of an articulated doll 11 and a pistol grip 12. Doll 11 may of course take any suitable configuration, such as a main body portion 13 (see also FIG. 2), a head 14 integral with body portion 13, arms 15,16 pivotally connected to the shoulders of body portion 13 by pivot pins 17,18, respectively, and thighs 19,20 pivotally connected to the lower part of body portion 13 by pivot pins 21,22, respectively. Legs 23,24 are pivotally connected to the lower ends of thighs 19,20, respectively, by pivot pins 25,26, respectively.

Figure 2:
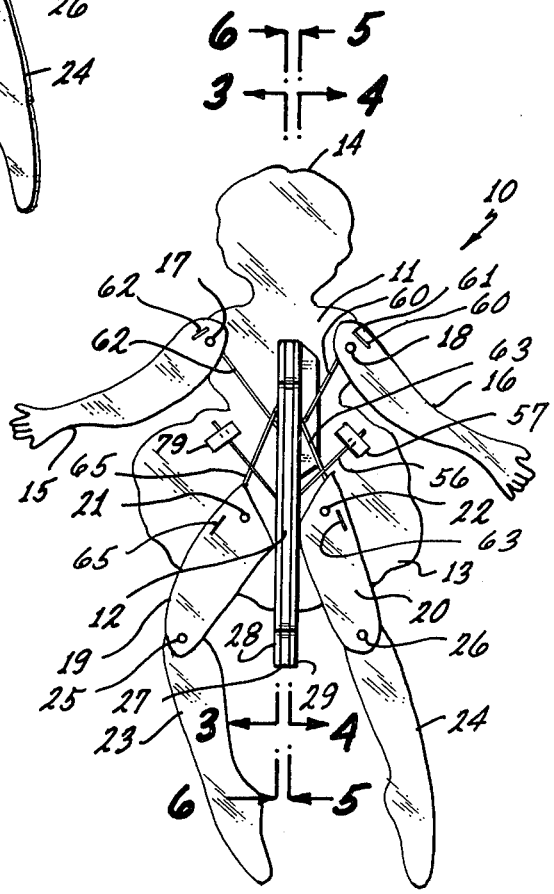
FIG. 2 is a rear plan view of the puppet of FIG. 1.

Grip 12 is comprised of a main operating panel sandwiched between panels 28,29 (FIG. 2). Panel 28 (FIG. 3) is generally L-shaped having four vertically spaced oval-shaped holes 30 through 33. Panel 29 (FIG. 4) is the mirror image of panel 28 having similarly spaced and shaped holes 34 through 37.

Central or main operating panel 27 is shown in FIGS. 5 and 6. As can be seen, panel 27 is L-shaped similarly to panels 28,29. Panel 27 also had four vertically spaced oval openings 38 through 41 similar to the openings in panels 28,29.

A first trigger assembly 42 includes an elongated portion 44 and a curved trigger portion 45. An abutment member 46 is mounted on panel 27 engagable by portion 44 when assembly 42 is pivoted. The terminal end 47 of trigger assembly 42 overlaps opening 40 as shown. A lower abutment member 48 is mounted below trigger portion 45 adapted to be engaged by portion 45 when pivoted.

An abutment member 49 is also mounted between openings 39 and 40 engagable by portion 45.

A second trigger assembly is pivotally connected to panel 27 by pivot pin 51. Trigger assembly 50 includes an elongated portion 52 and a trigger portion 53. Trigger portion 53 overlaps opening 38. An abutment member 54 is provided on panel 27 between openings 38 and 39. An abutment member 55 is provided on panel 27 below portion 52. Trigger assembly 50 thus engages abutment members 54,55, when pivoted.

A string 56 passes through opening 100 in panel 27 and abutment member 55 and passes outward through panels 28 and 29. This string 56 extends to and is connected to body portion 13 at point 57 to one side of grip 12 (see FIGS. 1 and 2), and at point 79 to the opposite side of grip 12 (see FIG. 2). A pair of openings 58,59 are provided in panel 27. As will be discussed, string 60 from a trigger assembly on the opposite side of panel 27 extends to and is connected to arm 16 (FIGS. 1 and 2). As seen in FIG. 1, all string connections may be provided by the end of the string, as string 60, passing through a hole 61 in the limb and glued or taped to the limb. The remaining limb string connections are similar so no further discussion is deemed necessary.

Referring again to FIG. 5, string 62 attached to trigger portion 52 extends through opening 59 and is attached to arm 15 (FIGS. 1 and 2). A string 63, from the other side of panel 27, as will be discussed, extends out of hole 64 to thigh 20 (FIGS. 1 and 2). String 65 is attached to trigger portion 44 and extends out of hole 66 in panel 27 to thigh 19 (FIGS. 1 and 2).

As seen in FIG. 6, the opposite side or face of panel 27 is similar and includes an upper trigger assembly 67 pivoted at pivot pin 68 and engagable with abutment members 69,70 on panel 27. Lower trigger assembly 71 is pivoted at pivot pin 72 and engages abutment member 73 and a pair of abutment members 74,75, on panel 27, between openings 38,39 and 39,40, respectively.

The trigger portions 76,77, respectively, of trigger assemblies 67,71 overlap openings 39,41, respectively, as shown. String 65 extends out of hole 66, as previously discussed with respect to FIG. 5, and connects to thigh 19 (FIGS. 1 and 2). String 63 from hole 64 (FIG. 5) is connected to the elongated arm 80 of trigger assembly 67. String 60 from opening 58 is connected to the elongated arm 81 of trigger assembly 71. String 62 extends from opening 59 (and, of course, from trigger portion 52 of FIG. 5) to arm 15 (FIGS. 1 and 2).

The various abutment members heretofore described also act as suitable spacers for the panels so that all of the strings move freely between the panels and out of the various openings and the trigger assemblies pivot freely between the panels. Additional spacers may also be provided between the panels, such as along the peripheral edges, so that, in addition to spacing, the strings are totally contained between the panels.

As shown in FIG. 1, the trigger 12 through main panel 27, is preferably hingedly connected, at 82, to a flap 83 which may be secured to the back portion of body portion 13.

The articulation of the various limbs of the doll can best be understood by reference to FIGS. 1 and 2. When trigger portion 53 (FIG. 5) is engaged by the operator's finger extending into opening 30, FIG. 1, string 62 is moved to raise the arm 15. Release of portion 53 permits the arm to be lowered since the weight thereof returns portion 53 to its normal position.

When trigger portion 76 (FIG. 6) is engaged by the operator's finger extending into opening 31, string 60 is moved to raise arm 16 and release thereof likewise lowers the arm.

When trigger portion 45 is engaged in opening 32, thigh 19 is raised and, again lowered, when portion 45 is released. Finally, engagement of portion 77 raises the other thigh 20.

It can be seen that the trigger grip 12 can be grasped by the user with fingers extending through openings 30 to 33. Selective actuation of the trigger portions 53,76,45 and 77 moves the various limbs of the doll as heretofore described. The doll can thus be made to wave its arms and raise and lower its legs and appear to dance or the like.

Although any suitable materials may be used, such as plastic, wood or cardboard, stiff cardboard is preferred so the puppet can be inexpensively manufactured. The grip 12 can be folded at hinge 82 to lie flat against the back of body portion 13. In order to allow extension of various limb controlling strings 60, 63, 63 and 65 outward of the panels 28 and 29, the inner edges of these panels, at the back of the body portion, may be slightly relieved or concave as suggested in FIGS. 3 and 4. The hinge panel 83 may be an integral part of panel 27 and hinge 82 merely a fold line thereof.

The pivot pins may be plastic pins insertible into the members with the heads of the pins on each side of the members enlarged, as by spot welding, to prevent withdrawal thereof.

It can thus be seen that there is disclosed a simple and inexpensive puppet that can take any desired configuration and can be made as elaborate as desired. A child may have differing dolls or puppets, one operated by each hand, and put on shows or the like without danger of entanglement of the strings.

I claim:

1. In a puppet, a figure having a main body portion with a plurality of articulated limbs and a control therefor, said control comprising pistol grip means connected to the back of said figure, said grip means having a plurality of openings therein for insertion of the fingers of the operator of said puppet, said grip means further having a plurality of limb control members pivotally mounted thereon and accessible from said openings, and flexible members interconnecting said control members and said limbs whereby movement of said control members at said openings moves said flexible members thereby moving the limbs of said figure, each of said control members including a first elongated portion extending toward said figure and terminating in a free end, and a second curved portion extending from said elongated portion away from said figure and integral with said elongated portion, each of said control members being pivotally connected to said grip means substantially at the intersection of said elongated portion and said curved portion, the curved portions terminating in ends normally disposed partway in selected ones of said openings in said grip means for access by the fingers of said operator, and abutment means on said grip means for limiting the pivotal movement of said control members, selected ones of said control members being mounted on one side of said grip means and the remainder of said control members being mounted on the other side of said grip means, said pistol grip means being generally L-shaped with first grip portion connected to said figure and a second grip portion, having said openings therein, extending downwardly from said first grip portion, the elongated portions of said control members extending along said first grip portion and the curved portions of said control members extending in said second grip portion to and partway in said openings, said control members on each side of said grip means including first and second control members, said first control members having their elongated and curved portions substantially longer than the elongated and curved portions of said second control members and overlying the same with the ends of said curved portions on one side of said grip means extending into staggered ones of said openings.

2. An articulated puppet comprising:

a planar main body portion simulating a doll having shoulders and a torso having a pair of planar arms pivotally connected at said shoulders and a pair of planar thighs pivotally connected at the lower end of said torso and legs on said thighs;

an L-shaped pistol grip comprised of a main planar panel sandwiched between a pair of panels, said main planar panel being hingedly connected to the back of said main body portion whereby said grip may be folded back against said main body portion for storage or moved out generally perpendicular thereto for use, at least four vertically spaced openings extending through said panels for receiving the fingers of an operator therein, said panels being provided with spacing means forming a space between said main panel and each of said panels on both sides of said main panel, four control members pivotally mounted in the spacing between said panels, each of said control members being comprised of an elongated portion extending along said grip to said main body portion and a curved portion extending to and terminating partway within one of said openings, each of said control members being pivotally connected to said main panel between said curved and elongated portions, abutment members on said panels for limiting the pivotal movement of said control members, two of said control members being mounted on one side of said main panel and the remaining two control members being mounted on the other side of said main panel, the ends of said curved portions terminating in respective ones of said openings so that the four control members have ends terminating in the four openings;

a first string passing through said grip below said control members and connected to said body member on both sides of said grip;

a second string connected to the elongated end of one of said control members on one side of said main panel passing through an opening in said main panel and connected to one of said arms at a point offset from the pivotal connection thereof to said body portion;

a third string connected to the elongated end of one other of said control members on the same side of said main panel as said one control member to which said second string is connected, and passing through an opening in said main panel and connected to one of said thighs at a point offset from the pivotal connection thereof to said body portion on the same side of said body portion as said second string connected to one of said arms;

a fourth string connected to the elongated end of one of said control members on the other side of said main panel passing through an opening in said main panel and connected to the other of said arms at a point offset from the pivotal connection thereof to said body portion;

a fifth string connected to the elongated end of one other of said control members on the same side of said main panel as said control member to which said fourth string is connected, and passing through an opening in said main panel and connected to the other of said thighs at a point offset from the pivotal connection thereof to said body portion on the same side of said body portion as said fourth string connected to one of said arms whereby selective movement of the ends of the curved portions through said finger receiving openings by the fingers of an operator pivots said control members thereby moving said strings to raise the arms or thighs connected thereto and release of said ends of said curved portions allows the arms or thighs to drop under their own weight returning the control members to their initial position.

3. In the puppet of claim 2 wherein said main body portion, said arms and said thighs, said control members and said panels are made of cardboard.

4. In a puppet, a figure having a planar main body portion with a plurality of articulated limbs including a pair of planar arms pivotally connected to said main body portion and a pair of planar legs pivotally connected to said main body portion, and a control therefor, said control comprising a pistol grip, said pistol grip being a planar member hingedly connected to the back of said main body portion and including a main panel sandwiched between a pair of panels, said grip having a plurality of openings therein for insertion of the fingers of the operator of said puppet, said openings being generally vertically aligned and extending through all of said panels, said grip further having a plurality of limb control members pivotally mounted to said main panel and accessible from said openings, and flexible members interconnecting said control members and said limbs whereby movement of said control members at said openings moves said flexible members thereby moving the limbs of said figure, each of said control members including a first elongated portion extending toward said figure and terminating in a free end, and a second curved portion extending from said elongated portion away from said figure and integral with said elongated portion, each of said control members being pivotally connected to said main panel substantially at the intersection of said elongated portion and said curved portion, the curved portions terminating in ends normally disposed partway in selected ones of said aligned openings in said panels for access by the fingers of said operator, and abutment means on said panels for limiting the pivotal movement of said control members, at least four openings being provided in said grip, selected ones of said control members being mounted on one side of said main panel and the remainder of said control members being mounted on the other side of said main panel, said pistol grip being generally L-shaped with a first grip portion connected to said figure and a second grip portion, having said openings therein, extending downwardly from said first grip portion, the elongated portions of said control members extending along said first grip portion and the curved portions of said control members extending in said second grip portion to and partway in said openings, said control members on each side of said main panel being comprised of a pair of first and second control members, said first control members having their elongated and curved portions substantially longer than the elongated and curved portions of said second control members and overlying the same with the ends of said curved portions on one side of said main panel extending into staggered ones of said openings.

5. In the puppet of claim 4 wherein said flexible members are strings connected at one end to each of said limbs at a point offset from the pivotal connection of the limb to said main body portion and at the other end to the free ends of said elongated portions.

6. In the puppet of claim 8 including a flexible member connected at each end to said main body portion on opposite sides of said grip and passing through said grip.

* * * * *